United States Patent [19]

Walther

[11] Patent Number: 5,031,532

[45] Date of Patent: Jul. 16, 1991

[54] FLEXOGRAPHIC PRINTING MACHINE

[75] Inventor: Karl H. Walther, Rottendorf, Fed. Rep. of Germany

[73] Assignee: Metronic Gerätebau GmbH & Co., Veitshöchheim, Fed. Rep. of Germany

[21] Appl. No.: 434,679

[22] PCT Filed: Sep. 28, 1988

[86] PCT No.: PCT/DE88/00597

§ 371 Date: Oct. 30, 1989

§ 102(e) Date: Oct. 30, 1989

[87] PCT Pub. No.: WO89/02824

PCT Pub. Date: Apr. 6, 1989

[30] Foreign Application Priority Data

Oct. 2, 1987 [DE] Fed. Rep. of Germany ..... 3733375

[51] Int. Cl.[5] ..... B41F 13/24

[52] U.S. Cl. ..... 101/351; 101/247; 101/248; 101/209

[58] Field of Search ..... 101/351, 352, 247, 248, 101/219, 209, 138, 139, 140, 143, 144, 145, 137, 218, 182, 184, 185

[56] References Cited

U.S. PATENT DOCUMENTS

| | | | |
|---|---|---|---|
| 3,491,686 | 1/1970 | Zurick | 101/352 |
| 3,738,265 | 6/1973 | Saueressig | 101/351 |
| 4,309,945 | 1/1982 | Marion | 101/351 |
| 4,362,098 | 12/1982 | Stelling et al. | 101/351 |
| 4,384,522 | 5/1983 | Ehlers et al. | 101/352 |
| 4,567,823 | 2/1986 | Hummel et al. | 101/352 |
| 4,602,562 | 7/1986 | Uttenhues et al. | 101/352 |

FOREIGN PATENT DOCUMENTS

| | | |
|---|---|---|
| 2145007 | 3/1973 | Fed. Rep. of Germany . |
| 1261619 | 4/1961 | France . |

*Primary Examiner*—Edgar S. Burr
*Assistant Examiner*—Joseph R. Keating
*Attorney, Agent, or Firm*—Jones, Tullar & Cooper

[57] ABSTRACT

A flexographic printing machine has a printing block cylinder, an impression cylinder and a duct roller that is immersed in an ink trough. The printing block cylinder is rotatably supported by exchangeable bearing blocks that are removably secured to spaced support beds. Each support bed is mounted on an eccentric having a journal which is carried by side plates of the printing machine. The support beds are movable both horizontally and vertically to shift the printing block cylinder between various positions.

8 Claims, 2 Drawing Sheets

FLEXOGRAPHIC PRINTING MACHINE

FIELD OF THE INVENTION

The present invention is directed to a flexographic printing machine. More particularly, the present invention is directed to a flexographic printing machine for printing web materials. Most specifically, the present invention is directed to a flexographic printing machine which is adaptable to various printing formats and sizes. The printing block or plate cylinder is supported in bearing blocks which are secured to a bed. The bearing blocks for the plate cylinder can be removed from the bed and other, different sized bearing blocks substituted therefore. This allows various sizes of printing plate or block cylinders to be used in the flexographic printing machine. Additionally, the position of the bed, which effects the printing pressure between the plate cylinder and the impression cylinder, can be adjusted.

DESCRIPTION OF THE PRIOR ART

Flexographic printing machines are generally well known in the art. These printing devices typically include a printing block or plate cylinder, a screened ink duct roller (anilox type), an ink duct or fountain which supplies ink to the ink duct roller (anilox type), and an impression cylinder. It is often the situation that the prior art flexographic printing machine is intended to be used in a single printing format to print a web or sheets of a given size. Flexographic printing machines of this type are not readily adaptable to different formats and cannot accommodate printing block cylinders that may have various diameters. This lack of adaptability has meant that a flexographic printing machine can only be used with one size of printing block or plate cylinder. Prior attempts to impart printing format flexibility to a flexographic printing machine have required various complex adjustable carriage assemblies which have required horizontal and vertical carriage guidance devices. Such complex structures have generally been unsatisfactory and have not provided a flexographic printing machine which is truly variable in terms of printing format.

It will thus be seen that a need exists for a flexographic printing machine for printing web materials that needs no carriage guidance. The flexographic printing machine of the present invention, as will be discussed shortly, provides such a machine and is clearly an advance in the art.

SUMMARY OF THE INVENTION

It is an object of the present invention to provide a flexographic printing machine.

Another object of the present invention is to provide a flexographic printing machine for printing web materials.

A further object of the present invention is to provide a flexographic printing machine that is adaptable to various printing formats.

Still another object of the present invention is to provide a flexographic printing machine that needs no carriage guidance.

Yet a further object of the present invention is to provide a flexographic printing machine having replaceable bearing blocks for the printing plate cylinder.

Even still another object of the present invention is to provide a flexographic printing machine in which the printing plate cylinder can be disengaged from its drive mechanism.

As will be discussed in the description of the preferred embodiment which is set forth subsequently, the flexographic printing machine in accordance with the present invention includes a printing block or plate cylinder, a cooperating impression cylinder and an ink duct roller and ink duct to supply ink to the printing plate cylinder. The plate cylinder is supported in spaced bearing blocks which are carried by horizontal slidable beds. Various printing formats can be attained by changing these bearing blocks to thereby allow the use of different printing block cylinders.

One of the advantages which is attainable with the present invention is that no horizontal or vertical carriage guidance is necessary. Despite the variability in terms of printing format, the impression cylinder and the screened cylinder can be rigidly supported in the lateral frames. Adaptation to other printing formats can be accomplished quickly, merely by replacing the bearing blocks to receive the printing block cylinder in the new format. To accomplish such a replacement, interchangeable bearing blocks that all have the same outside dimensions and differ from one another only in the location of the bearing bore in the bearing block can be used. To prevent the printing ink from drying out on the cylinders, the printing block cylinder can be disengaged from the drive mechanism while the rest of the printing machine continues to operate in the "printing off" position, so that while in this position printing blocks can be installed or removed.

In contrast with prior flexographic printing assemblies, the flexographic printing machine of the present invention provides an adaptable printing press. This press apparatus thus is a substantive advance in the art.

BRIEF DESCRIPTION OF THE DRAWINGS

While the novel features of the flexographic printing machine in accordance with the present invention are set forth with particularity in the appended claims, a full and complete understanding of the invention may be had by referring to the detailed description of the preferred embodiment, which is set forth subsequently, and as illustrated in the accompanying drawings in which:

DESCRIPTION OF THE PREFERRED EMBODIMENT

Figure 1:
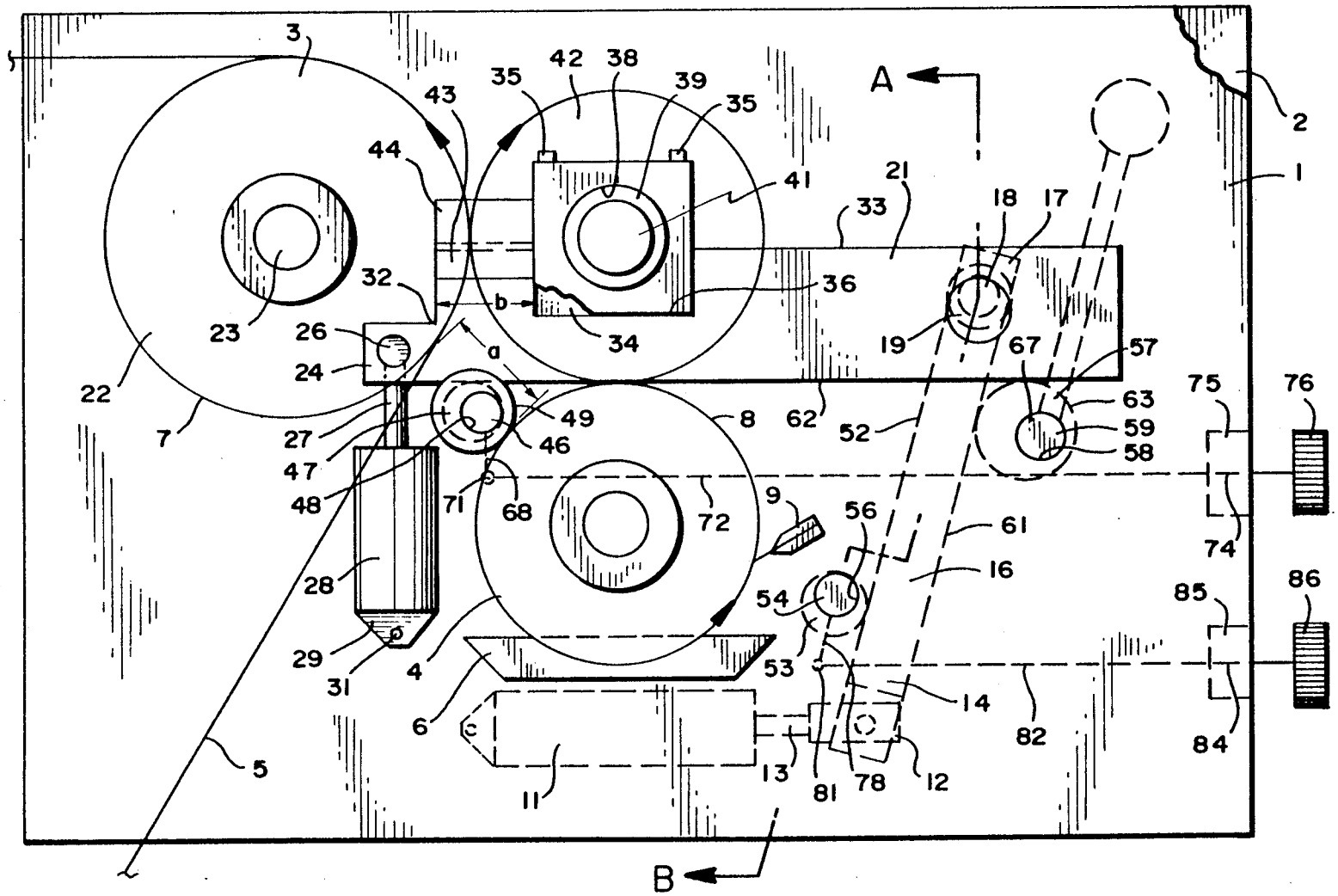
FIG. 1 is a schematic side elevation view of a flexographic printing machine in accordance with the present invention.

Referring initially to FIG. 1, there may be seen a preferred embodiment of a flexographic printing machine in accordance with the present invention. An impression cylinder 3 and a screened duct roller 4 (anilox type) are supported in two spaced side plates 1 and 2. The duct roller 4 dips into an ink trough 6 that is disposed between the lateral frames 1, 2 and which is secured to inner sides of the frames 1 and 2. An undershot squeegee, or doctor blade 9 is positioned against the duct roller 4. The impression cylinder 3 and duct roller 4 are disposed with their jackets or surfaces spaced apart by a fixed distance a. The axis of rotation of the duct roller 4 is in the fourth quadrant, with respect to the axis of rotation of the impression cylinder 3.

Figure 2:
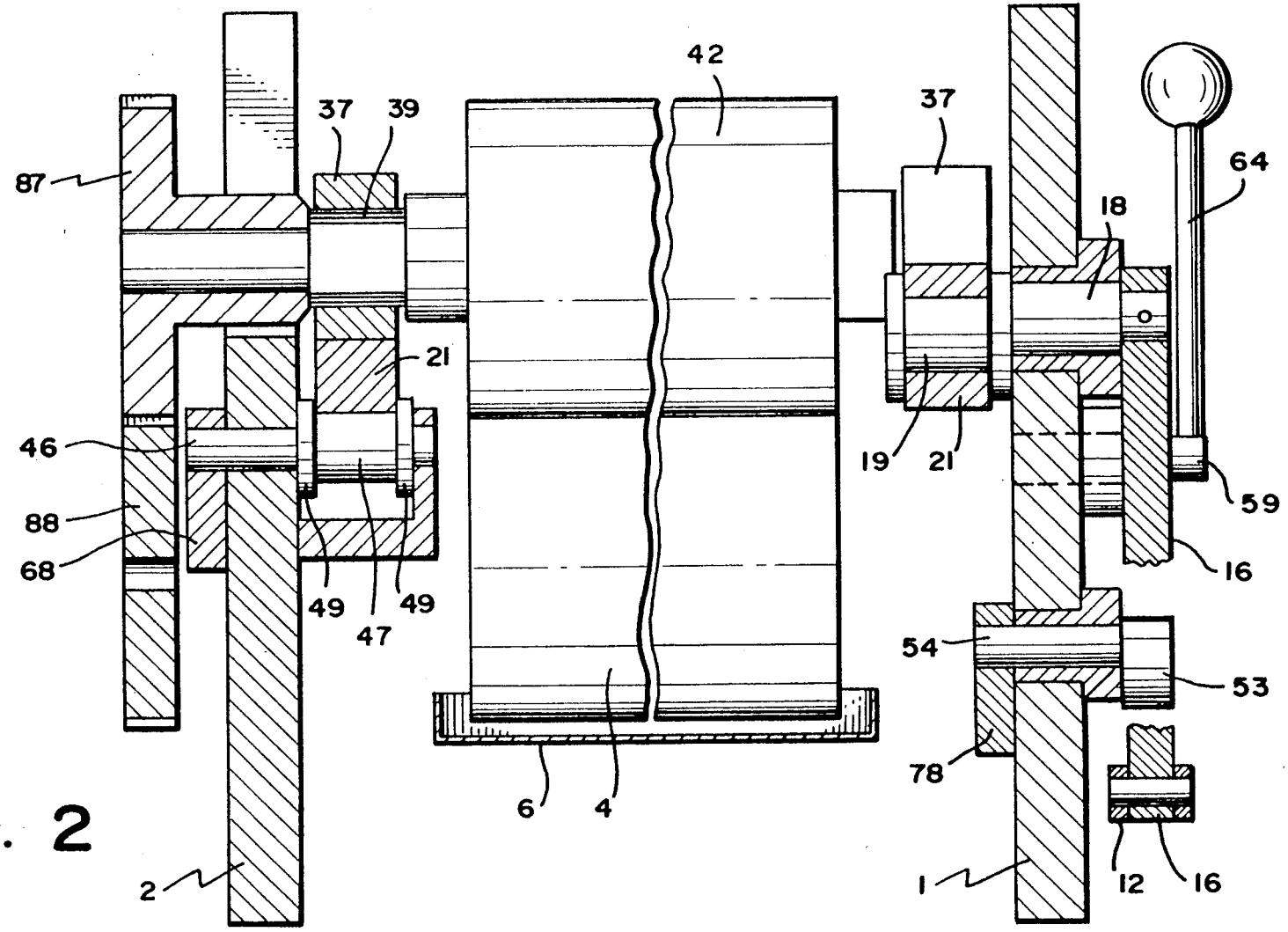
FIG. 2 is a cross-sectional view taken along line A-B of FIG. 1.

A plurality of elements and structures, which form a portion of the flexographic printing machine of the present invention are present on each of the side frames or plates 1 and 2. For the sake of simplicity they will each be described hereinafter with respect to side frame 1. However, it will be understood that, in absence of an assertion to the contrary, each element described with respect to side frame is also present on side frame 2. A horizontally disposed bidirectional pneumatic cylinder 11 is secured on an inner side of the side plate 1, underneath the ink trough 6. A lower end 14 of a lever rod 16, which extends obliquely upwardly, is pivotably connected to an end 12 of a piston rod 13, which extends toward the right of the pneumatic cylinder 11, as seen in FIG. 1. An upper end 17 of the lever rod 16 is form-fittingly connected to a bearing tang or journal 18 of a cylindrical first eccentric 19. This journal 18 is plugged into a bore in the upper end 17 of the lever rod 16, as seen in FIG. 2 and is connected to it with pins. The bearing tang 18 is also rotatably supported in a bore in the side plate 1.

The first eccentric 19 is supported in a bore located in a horizontally extending bed 21. The bed 21 has a first end which protrudes outward to the right as seen in FIG. 1 a short distance past the bearing bore for the eccentric 19. On its left or second end, the bed 21 extends between the inside of the side plate 1 and an end face 22 of the impression cylinder 3 into the vicinity of the axis of the impression cylinder 3, and terminates in a rectangular protrusion 24. An upper end 26 of a piston rod 28 portion of a vertically disposed pneumatic cylinder 28 is pivotably connected to the protrusion 24. A countersupport 29 for the lower end of the pneumatic cylinder 28 is pivotably secured to a journal 31, that is attached to the inside of the side plate 1. A rectangular recess 34 is milled out or otherwise formed generally adjacent the left end of bed 21 and is spaced apart by a distance b from the beginning 32 of the protrusion 24. Recess 34 extends downwardly from an upper, horizontal face 33 into the bed 21. A bottom 36 of the recess extends parallel to the upper surface 33 of the bed 21.

A block-shaped bearing block 37 fits into the recess 34. The bearing block 37 is secured by vertical screws 35 to the bottom 36 of the bed 21. A shaft 41 of a printing block or plate cylinder 42 is rotatably supported in a bearing bore 38 in the bearing block 37 by a pendulum bearing 39. The bed 21 is guided between two legs 43 extending downward of a fork 44 firmly screwed to the inside of the side plate 1. These legs 43 guide the portion of the bed 21 between recess 34 and protrusion 24 in its vertical motion, as will be discussed subsequently.

The axis of rotation of a bearing journal or tang 46 of a second eccentric 47 is located on an imaginary line which passes through the centers of rotation of the impression cylinder 3 and the duct roller 4. The bearing tang 46 is supported in a bore 48 in the side plate 1. The cylindrical second eccentric 47 has collars 49 protruding beyond on its left and right sides. Between them, an underside portion 62 of the bed 21 rests on the second eccentric 47, as may be seen most clearly in FIG. 2.

As may also be seen most clearly in FIG. 2, a bearing bore 56 for a bearing tang 54 of a cylindrical third eccentric 53 is disposed beneath a horizontal plane extending through the axis of rotation of the duct roller 4. The lower potion of the third eccentric 53 rests on the left side face of the lever rod 16, as may be seen in FIG. 1.

A fourth cylindrical eccentric 57 is rotatably supported in a bearing bore 58 in side plate 1 by means of its bearing journal 59. This bearing bore 58 is located on the right side of plate 1 beside a right side face 61 of the lever rod 16 and below an underside 62 of the bed 21. It is disposed such that the eccentric 57, with its face or surface 63, can be moved toward and away from the right side face 61 in approximately the upper third of the lever rod 16. An indexing lever 64 is located in front of the side plate 1 and is form-fittingly connected to the bearing tang 59. There is only one indexing lever 64, and one cooperating synchronous spindle 67. The synchronous spindle 67 joins the two fourth eccentrics 57, which are supported in the side plates 1 and 2 in their bearing bores 58 by means of their bearing tangs 59.

A first short lever arm 68 is form-fittingly connected to the bearing tang 46 of the second eccentric 47. A horizontally extending bolt 71 is supported in a bore in a free end of lever arm 68 and has a transversely extending continuous threaded bore. An external thread of a horizontal threaded first spindle 72 engages the inside of this threaded bore of bolt 71. The threaded spindle 72 is rotatably but not displaceably secured, on its right-hand, smooth end 74, in a retaining means 75 that is attached to the outside of the side plate 1. The threaded spindle 72 ends in a rotatable knob 76 which is form-fittingly connected to it.

A second short lever arm 78 is form-fittingly connected to the bearing tang 54 of the third eccentric 53. The bore of this lever arm supports a horizontally extending bolt 81, which also has a continuous threaded bore that extends transversely. Engaging the inside of this threaded bore is an external thread of a horizontally extending second threaded spindle 82. The second threaded spindle 82 is rotatably but not displaceably held on its right-hand smooth end 84 in a retaining means 85 that is attached to the outside of the side plate 1. The threaded spindle 82 terminates in a rotatable knob 86 form-fittingly connected to it.

In operation, when a pressurized fluid is supplied to cylinder 28, the piston rod 27 of the cylinder will be extended upwardly. In this extended state, the piston rod 27 pivots the bed 21 upward about the eccentric 19. In this position, the printing block cylinder 42 is moved away from the jacket of the duct roller 4. In the retracted state, the piston rod 27 pivots the bed 21 downward about the eccentric 19 until the printing block cylinder 42 is in contact with the jacket of the duct roller 4. The spacing between the printing block cylinder 42 and the duct roller 4 in the "on" position depends on the rotational angle set for the second eccentric 47 on which the bed 21 rests. Since the two eccentrics 47 on side frames 1 and 2 are pivotable separately from one another about their bearing tangs 46, a separate setting can be provided on either side of the side plate. Turning the rotatable knob 76 turns the spindle 72 as well. Since spindle 72 is held in the retaining means 75 in such a way that it is not displaceable, it pivots the lever arm 68 about the axis of rotation of the bearing tang 46 by the threaded bolt 71, in whichever direction the knob 76 is turned. Since the eccentric 47 is form-fittingly connected to the bearing tang 46, the eccentric directly follows the pivoting motion of the lever arm 68.

To position the printing block cylinder 42 toward and away from the impression cylinder 3, thus placing it in "printing on" and "printing off" positions respectively, the piston rod 13 of the pneumatic cylinder 11 is extended and retracted. Movement of the piston rod 13, through the fork head 12, causes the lever rod 16 and hence the bearing tang 18 to pivot the eccentric 19. This rotation of the first eccentric 19, which is supported in the bore in the bed 21, moves the bed 21 and hence the printing block cylinder 42 toward or away from the impression cylinder 3.

The spacing between the printing block or plate cylinder 42 and the impression cylinder 3, and hence the intensity of the "printing on" position, is set separately by the two rotatable knobs 86. The threaded spindle 82 carried in the retaining means 85 secured to the side plate engages the internal thread of the bolt 81. The bolt 81 is supported in the lower end of the lever arm 78. Depending on the direction of rotation of the rotatable knob 86, the lever arm 78 and hence the third eccentric 53 are pivoted in one direction or the other. The third eccentric 53 forms a stop for the lower end 14 of the lever rod 16 and thus defines the terminal position in the "printing on" position. Since both rotatable knobs 86, in a manner similar to the rotatable knobs 76, are adjustable independently of one another, different "printing on" limitations on both sides of the side plate are possible by means of different positions of the two third eccentrics 53. This makes it possible to skew the printing block cylinder 42 horizontally.

As the single indexing lever 64 is moved into its left-hand terminal position or "printing block application position", the fourth eccentrics 57 follow along until they are maximally spaced away from the lever rod 16. The pneumatic cylinders 11 exert pressure in response, until the lever rods 16 again rest on the eccentrics 57 associated with them. In this position just now described, the drive pinion 87 for the printing block cylinder 42 becomes disengaged from the gear wheel 88 of the primary drive mechanism. The printing block cylinder 42 can now be rotated by hand, for instance in order to apply printing blocks to the printing block cylinder 42 or to remove them.

The "printing off" position is determined by the position of the two eccentrics 53, each of which has a lower end 13 of one lever rod 16 resting on it. Issuing the "printing off" command extends the piston rods 13 outward, until the lower ends 14 rest on the two eccentrics 53. In this process the printing block cylinder 42 moves to a maximum of a few millimeters away from the impression cylinder 3. In this position, the sole drive pinion 87 remains in engagement with the gear wheel 88 of the drive mechanism, not shown.

The flexographic printing machine of the present invention may be changed over to a different printing format. This is accomplished by removing one set of bearing blocks 37 from the recesses 34 in the beds 21 and by substituting a different set of bearing blocks 37. All of the bearing blocks 37 have the same external dimensions. The bearing bores and bearings of various bearing blocks, however, are adapted to the various diameters of the printing block cylinders 42 which can be used in the flexographic printing machine of the present invention.

A web of paper, such as depicted at 5, may be printed by being passed between the printing block or plate cylinder 42 and the impression cylinder 3. As discussed above, the force with which the plate cylinder 42 contacts the impression cylinder 3 may be varied both overall and side to side. Similarly, the printing plate cylinder's size may be varied to provide different printing formats by removal of one set of bearing blocks and by substitution of another set. It will thus be seen that the flexographic printing press in accordance with the present invention provides a high degree of printing format variability and control in a manner that is far superior to prior art devices.

While a preferred embodiment of a flexographic printing machine in accordance with the present invention has been set forth fully and completely hereinabove, it will be apparent to one of skill in the art that a number of changes in, for example, the type of half-tone ink duct roller, the type of impression cylinder, the particular type of printing plates or blocks and the like may be made without departing form the true spirit and scope of the present invention which is to be limited only by the following claims.

What is claimed is:

1. A flexographic printing machine comprising:

a printing block cylinder;

spaced replaceable bearing blocks rotatably supporting said printing block cylinder;

a rotatable impression cylinder positioned for contact with said printing block cylinder, and a rotatable duct roller and an ink trough, said duct roller contacting ink in said ink trough and supplying the ink to said printing block cylinder;

side frames of the flexographic printing machine, said impression cylinder and said duct roller being fixed for rotation between said side frames of the flexographic printing machine;

a pair of spaced, horizontally extending, and generally horizontally shiftable printing block cylinder bearing block support beds, each of said beds removably supporting one of said replaceable bearing blocks which rotatably supports a journal of said printing block cylinder;

a bore in a first end of each of said beds, first eccentrics rotatably positioned in said bores in the first ends of each of said beds, and having first journals which are carried in said side frames, rotation of said first eccentrics effecting a shifting of said beds to shift said printing block cylinder with respect to said impression cylinder; and means for supporting a second end of each of said beds for pivotable movement to shift said beds and said printing block cylinder with respect to said duct roller, said means including a piston rod attached to said second end of each of said beds generally adjacent said replaceable bearing block, said piston rod being movable by a first fluid actuated cylinder.

2. The flexographic printing machine of claim 1 further including a second eccentric rotatably supported by each of said side frames, each of said second eccentrics supporting one of said beds.

3. The flexographic printing machine of claim 2 further including a first lever arm and a second eccentric adjusting means wherein a journal of each of said second eccentrics carries said first lever arm which is connected to said second eccentric adjusting means.

4. The flexographic printing machine of claim 1 further including lever rods and second fluid actuating cylinders wherein first journals of said first eccentrics are pivotably connected by said lever rods to said second fluid actuated cylinders.

5. The flexographic printing machine of claim 4 wherein each said lever rod has a third eccentric disposed on a first side of it and a fourth eccentric disposed on a second side of it, each of said third and fourth eccentrics being rotatably supported in said side frames and being movable into contact with said lever rod.

6. The flexographic printing machine of claim 5 further including an adjusting device for said third eccentric.

7. The flexographic printing machine of claim 6 further including an adjusting device for said fourth eccentric.

8. A flexographic printing machine comprising:

a printing block cylinder including journals and spaced, replaceable bearing blocks rotatably supporting said printing block cylinder, side frames a rotatable impression cylinder positioned for contact with said printing block cylinder, and a rotatable duct roller and an ink trough, said duct roller contacting ink in said ink trough and supplying ink to said printing block cylinder, said impression cylinder and said duct roller being fixed for rotation between said side frames of the flexographic printing machine;

a pair of spaced, horizontally extending and generally horizontally shiftable printing block cylinder bearing block support beds, each of said support beds removably supporting one of said replaceable bearing blocks for selective replacement and substitution of said bearing blocks for rotatably supporting said journals of different sized ones of said printing block cylinders;

first eccentrics rotatably positioned in bores in first ends of each of said beds, and having first journals which are carried in said side frames, rotation of said first eccentrics effecting a shifting of said beds to shift said printing block cylinder with respect to said impression cylinder;

means for supporting a second end of each of said beds for pivotable movement to shift said beds and said printing block cylinder with respect to said duct roller, said means including a piston rod attached to said second end of each of said beds generally adjacent said replaceable bearing block, said piston rod being movable by a first fluid actuated cylinder;

a second eccentric rotatably supported by each of said side frames, each of said second eccentrics slidably supporting one of said beds; and spaced lever rods each connected to one of said first journals of said first eccentric to effect rotation of said first eccentric in said side frames, said lever rods being connected to second fluid actuated cylinders.

* * * * *